United States Patent [19]

Hill

[11] 3,992,300

[45] Nov. 16, 1976

[54] APPARATUS FOR CONTROLLING IRON CONTENT OF A ZINC PHOSPHATING BATH

[75] Inventor: Edward Alexander Hill, Scotch Plains, N.J.

[73] Assignee: TRW Inc., Cleveland, Ohio

[22] Filed: Nov. 14, 1974

[21] Appl. No.: 523,779

Related U.S. Application Data

[62] Division of Ser. No. 292,595, Sept. 27, 1972, Pat. No. 3,874,951.

[52] U.S. Cl. ..... 210/167; 118/418; 118/603; 210/195 R; 210/205; 210/220

[51] Int. Cl.[2] ..... B01D 21/00

[58] Field of Search ..... 117/102 A; 118/418, 118/429, 602, 603, 610; 148/6.15 R, 6.15 Z; 210/167, 195 R, 220, 221 R, 198 R, 199, 200–202, 207, 208, 219; 261/36 R, 93

[56] References Cited

UNITED STATES PATENTS

| | | | |
|---|---|---|---|
| 2,128,311 | 8/1938 | Mertes | 210/50 |
| 2,138,349 | 11/1938 | Mallory | 210/63 |
| 2,678,873 | 5/1954 | Sable | 210/220 |
| 2,702,786 | 2/1955 | Hakes | 210/220 |
| 3,255,097 | 6/1966 | Williams | 210/167 |
| 3,261,711 | 7/1966 | Sallo | 118/602 |
| 3,575,711 | 4/1971 | Krofchak | 134/13 |
| 3,772,187 | 11/1973 | Othmer | 210/220 |
| 3,776,186 | 12/1973 | Coch | 118/603 |

FOREIGN PATENTS OR APPLICATIONS

| | | | |
|---|---|---|---|
| 679,869 | 9/1952 | United Kingdom | 148/6.15 R |

*Primary Examiner*—Charles N. Hart
*Assistant Examiner*—Peter A. Hruskoci
*Attorney, Agent, or Firm*—James R. O'Connor

[57] ABSTRACT

An apparatus for controlling the iron content of a zinc phosphating process. The processing bath is continuously aerated and agitated to precipitate iron compounds out of solution and maintain the precipitate in suspension. The bath is constantly recirculated through a series of settling tanks or a single compartmentalized tank wherein the precipitate is settled out of solution and from which relatively clarified solution is discharged back to the processing bath. Periodically iron bearing sediment is removed from the settling tanks for disposal as solid waste.

2 Claims, 1 Drawing Figure

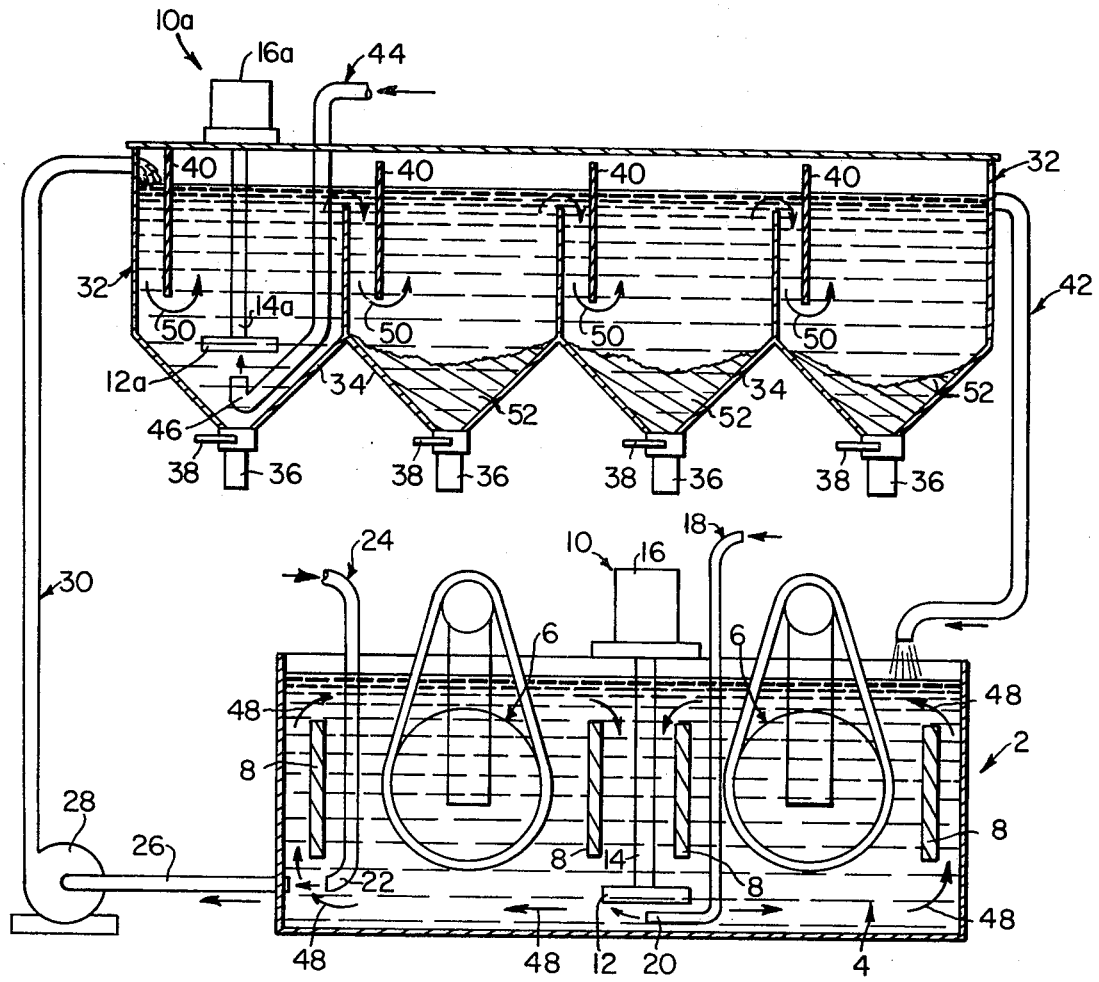
10a
16a
44
40
40
40
40
32
32
42
50
50
50
50
14a
12a
34
34
52
52
52
46
38
36
38
36
38
36
38
36
24
10
16
18
30
6
6
48
48
2
8
28
26
8
14
8
22
48
48
48
12
20
4

APPARATUS FOR CONTROLLING IRON CONTENT OF A ZINC PHOSPHATING BATH

This is a division of application Ser. No. 292,595, filed Sept. 27, 1972, now U.S. Pat. No. 3,874,951.

BACKGROUND OF THE INVENTION

1. Field of the Invention

The invention relates to immersion-type zinc phosphating systems and particularly to methods for controlling iron content and sludge accumulation in the processing bath tanks of such systems.

2. Description of the Prior Art

In applying zinc phosphate coating to steel parts in immersion-type phosphating systems, the dissolved iron content of the phosphating bath solution must be controlled to prevent retardation of the deposition of zinc phosphate in the coating process, i.e. to maintain the efficiency of an effectively monitored bath.

One past, and still too prevalent, practice has been to frequently shut down the system and dump the phosphating bath which has reached an unacceptable dissolved iron concentration level, clean the processing tank to remove accumulated sludge, pour a new bath, and then reactivate the system. The obvious disadvantages of this method are excessive equipment down time, nonproductive labor expenditures, substantially increased chemical consumption, and variations in the quality and uniformity of the phosphate coating on work being processed. In addition, the dumping of contaminated baths severely taxes the digestive capacities of local sewage treatment facilities and provides for a massive injection of pollutants where sumps continue to be drained directly into watercourses.

A somewhat more economical, but less than optimum, method of control has been to precipitate dissolved iron out of the bath by such means as supplying chemical additives to the bath or periodic batch aeration. The iron precipitate settles and builds up as sludge on the sides and base of the processing tank and periodically the system is shut down to permit scraping and removal of the accumulated sludge from the tank. Frequently, the phosphating bath is temporarily pumped to a storage tank while cleaning of the processing tank is carried out with the bath being later pumped back into the processing tank and brought up to a specified operating level. While the latter procedures are certainly preferable to that first mentioned from the aspects of pollution control and reduction of zinc phosphate consumption, they nevertheless require periodic equipment shutdown, expenditures for nonproductive labor, expenditures for chemical additives to precipitate the iron, expenditures for storage tanks and pumping equipment if the bath is to be temporarily drained and reconstituted after tank cleaning, expenditures for batch aeration equipment if that method of precipitating the iron is to be employed in lieu of chemical precipitation, and possible expenditures for one or more standby systems to be utilized while a primary system is being batch aerated and desludged. Further, chemical additives to promote iron precipitation frequently adversely affect the quality of zinc phosphate coatings.

Iron precipitation combined with continuous decanting and replacement of the bath solution can be employed to extend the time interval between shutdowns for complete processing tank cleaning and desludging. Decanting procedures, however, have proved costly regarding chemical consumption and present a pollution problem which, although it is not as acute as batch dumping, recommends against this method of iron control.

Those familiar with the art will readily appreciate the difficulty in achieving uniformity of phosphate coating when the dissolved iron content of an operating bath is constantly varying, as it is when the aforementioned methods of iron content control are employed. Since the phosphating chemical requirements change relative to the change in iron content, i.e. a higher iron level must be compensated for or offset by a higher phosphate chemical level, extremely close monitoring is necessary to minimize bath fluctuation and maintaining a uniform operating level.

The present invention is seen to provide an apparatus for iron control and waste disposal which represents a marked improvement over the procedures mentioned above, without materially increasing the capital expenditures for equipment necessary to implement the method and at the same time improving the quality of zinc phosphate coatings. The merits of the invention's contribution to the art will become clearly evident to one who proceeds to a consideration of the detailed description of the invention which follows:

SUMMARY OF THE INVENTION

To control the iron content of an immersion-type phosphating system, the phosphating bath is maintained in a constant state of turbulence for surface aeration and suspension of iron precipitate. A turbulence inducing mechanical mixer is located in the processing tank so as to induce a particularly strong turbulent flow of bath solution over the base and upwardly along the sides of the tank and past the bath heaters and around and through the work processing drums. The bath is constantly circulated by a pumping system from the processing tank through a series of settling tanks, or a single compartmentalized settling tank and back to the processing tank. Air, or pure oxygen, can be introduced into the bath solution at selected locations, advantageously at locations of maximum turbulence, to with, adjacent the mechanical mixer and the outlet from the processing tank to the pumping system, whereby the air or oxygen is driven or drawn into dispersion in the bath for maximum precipitation of dissolved iron. During passage of the bath solution through the settling tanks wherein the flow is relatively quiescent, the iron precipitate settles to the bottom of said tanks and the latter are periodically purged of iron bearing sediment which is disposed of as solid waste. Substantially clarified solution is discharged from the most downstream of the settling tanks back to the processing tank. The constant turbulent flow path in the bath directs the fresh or clarified solution throughout the area of the bath in which work is being processed and improves the uniformity of zinc phosphate deposition on the work. Optionally, an auxiliary tank or separate compartment may be located upstream of the settling tanks or compartments and the auxiliary tank may be equipped with a mechanical mixer and means for introducing additional air or oxygen into the solution to further enhance iron precipitation prior to entry of circulating solution into the settling tanks or compartments.

BRIEF DESCRIPTION OF THE DRAWING

The drawing depicts a schematic view of an apparatus for effecting iron content control of a zinc phosphating bath according to the improved method of the invention.

DESCRIPTION OF A PREFERRED EMBODIMENT

In the accompanying schematic drawing of the apparatus, there is depicted a main processing tank 2 filled substantially to its top with a zinc phosphating bath 4. Perforated rotatable drums 6 for receiving steel parts to be processed are immersed in the bath as are plate-type heat exchangers 8 located adjacent to but spaced from the sides of the tank for maintaining the bath at a prescribed operating temperature and directing the flow of bath solution as is described in detail hereinafter. A mechanical mixing device 10 includes a turbine-type impeller 12 immersed in the bath and disposed generally centrally adjacent the bottom of the tank 2. The impeller is adapted to be rotatably driven through connecting shaft 14 by a driving mechanism 16 suitably mounted at the top of the tank. Two pipes for conducting air or pure oxygen to the phosphating bath are connected to the tank 2. The first pipe 18 has its outlet 20 located directly beneath the impeller 12. The outlet 22 of the second pipe 24 is located in the lower region of the left end of the tank.

An intake pipe 26 disposed at the left end of the tank 2 leads to a circulating pump 28 which is in turn connected to transfer pipe 30 leading to the first or most upstream of a series of communicating auxiliary tanks or compartments 32. Each of the tanks or compartments 32 has a funnel-shaped bottom section 34 terminating in discharge ducts 36 normally closed by valves 38. Each of the tanks or compartments 32 also includes a transverse baffle 40 disposed substantially adjacent the inlet end of each tank. Return transfer pipe 42 leads from the last in series or most downstream of the tanks or compartments 32 back to the main processing tank 2. The first in series or most upstream of the tanks 32 is equipped with a mixing device **10*a* similar to the device of the main processing tank 2 and including a proportionally smaller turbine-type impeller 12*a* adapted to be rotatably driven through shaft 14*a* by driving mechanism 16*a* suitably mounted at the top of said first in series tank or compartment. An air or oxygen supply pipe 44 connected to the first tank 32 has its outlet 46 disposed directly beneath impeller 12*a*.**

During operation of the phosphating system to apply zinc phosphate coating to steel parts disposed in the rotating, perforate drums 6, mixing device 10 is constantly energized to effect continuous rotation of impeller-type turbine 12 and thereby agitate the bath 4 and produce a turbulent flow of bath solution within the main processing tank 2. A particularly strong turbulent flow of solution is produced in the direction of flow arrows 48 in the drawing, i.e. across the base of the tank upwardly along its sides and past the heaters 8, and around and through the work processing drums 6. The described turbulent flow pattern is effective to almost completely eliminate any buildup of iron phosphate sludge on the base or sides of the processing tank, the drums 6, and other system components submerged in the bath. Surface turbulence created in the bath provides for significantly increased aeration of the bath solution and the consequent precipitation of iron compounds etched from the work in process out of solution in the bath. The constant agitation of the bath maintains the iron precipitate in suspension. The precipitated iron is continuously purged from the bath by constantly operating circulating pump 28 to withdraw a measured amount of bath solution from the processing tank through intake pipe 20 and conduct the solution through transfer pipe 30 to the first of the auxiliary tanks or compartments 32. Solution discharged into the first auxiliary tank or compartment flows through the tanks in a substantially quiescent state along the flow path indicated by arrows 50 in the drawing, that is over the sides of the adjoining tanks or compartments and beneath each of the transverse baffles 34. During this quiescent downstream flow, the iron precipitate settles out of solution and accumulates as sediment or sludge 52 in the funnel-shaped lower sections of the auxiliary tanks, ergo the solution which eventually arrives at the upper end of the most downstream tank or compartment is substantially clarified. The clarified solution is discharged through return pipe 26 back to the upper region of the processing bath 4 where it is directed by the turbulent flow path in the main tank previously described, around and through the work processing drums 6. Thus, a flow of fresh bath solution is continually directed to the work in process. Periodically, the valves 38 are opened and the accumulated sediment 52 is forced downwardly, by the overhead liquid pressure through the ducts 36 and is carried off as solid waste to approved land fill disposal areas.

The work load imposed on the system will dictate the extent of aeration required to maintain the bath at an optimum operating level and thereby produce consistently uniform phosphate coatings. In many instances, efficient monitoring of the bath will indicate that surface aeration alone is insufficient to achieve maximum precipitation of the iron compounds present in the bath. In such instances precipitation may be enhanced by introducing compressed air or pure oxygen into the main processing tank 2 through pipe 18 and/or 24, and/or into the first of the auxiliary tanks 32 through pipe 44 and simultaneously energizing the secondary mixing device **10*a*. Selection of the last mentioned option in effect converts the first auxiliary tank from a settling tank to a back up or alternate aeration and precipitation tank and sedimentation takes place only in the succeeding downstream auxiliary tanks or compartments 32. By reason of the location of pipe outlets 20 and 46 air or oxygen introduced into the bath solution through either pipe 18 or 24 is whipped into dispersion in the bath solution by the respective impellers 12 and 12a. Air or oxygen introduced through pipe 24 is drawn into solution by reason of the proximity of outlet 22 to the intake pipe 26 of the circulating pump 28. In all cases the points of air or oxygen introduction coincide with points of heavy solution turbulence. As a given dissolved iron level, air or oxygen introduction through pipe 18, either continuously or periodically, will be sufficient to achieve the maximum iron precipitation required. When the iron compound level is higher than that which can be efficiently precipitated by the apparatus in the main processing tank, the auxiliary or back up treatment system may be employed in conjunction with the main system to compensate for the increased load. Under certain circumstances it may be advisable to controllably reduce the amount of iron precipitate present in the main processing tank and to generate precipitate primarily between said tank and the settling tanks, in which case air or oxygen is introduced through pipes 24 and 44 with the auxiliary mixer 10*a* energized but air or oxygen is not introduced into the bath 4 through pipe 18.** A selected combination of usage of the above described aeration means to vary the extent and location of iron precipitation affords optimum efficiency, minimum cost and maximum quality products under varying work loads where varying levels of dissolved iron compounds are experienced.

From the foregoing description, the reader will recognize that the improved apparatus for iron content control and sludge removal provides for a zinc phosphating system which can be operated with substantially constant bath analysis for indefinite time periods without requiring tank dumping or decanting, or oxidizing chemical addition or batch aeration to reconstitute the bath, with an almost negligible loss of useful bath solution. Obviously, the elimination of continuous run off or batch dumping of chemical pollutants into local sewage treatment systems or drains leading directly to watercourses represents a significant step in the direction of improved environmental quality control procedures.

Those who seek a more precise definition of the scope of the invention protected by these Letters Patent should now refer to the claims which follow.

I claim:

1. A closed end immersion-type zinc phosphating apparatus comprising:

a. a work processing tank housing a phosphating bath;

b. a plurality of work holding drums rotatably supported within the tank and at least partially immersed in the bath, said drums being spaced from each other and the walls of the tank;

c. a plurality of heat exchangers disposed in the bath for maintaining the bath at a desired operating temperature, certain of said heat exchangers being located between said drums and other of said heat exchangers being located between said drums and the walls of the tank;

d. a pipe extending into the tank and having an outlet located in the bath adjacent the bottom of the tank from which outlet air or oxygen is discharged into the bath to precipitate dissolved iron components out of solution in the bath;

e. a mechanical agitator disposed in the bath for creating turbulence in the bath to maintain the iron precipitate in suspension in the bath and inhibit the build up of iron phosphate solution on the walls of the tank, said agitator including an impeller located adjacent the bottom of the tank and said pipe outlet to cause air or oxygen discharging from said outlet to be directed outwardly and upwardly throughout the bath and around said heat exchangers and said drums;

f. means, including a second pipe having an inlet disposed adjacent the bottom of the tank and a pump, for conducting bath solution to an auxiliary tank associated with said work processing tank for effecting sedimentation of iron precipitate present in said solution; and g. means for conducting clarified solution from said auxiliary tanks back into the work processing tank.

2. An apparatus according to claim 1 including still another pipe extending into said work processing tank and having an outlet adjacent the inlet to the pipe for conducting bath solution to said auxiliary tanks, from which outlet additional aeration promoting gas is discharged into the bath.

* * * * *